US005379590A

United States Patent [19]

Hamburg et al.

[11] Patent Number: 5,379,590

[45] Date of Patent: Jan. 10, 1995

[54] AIR/FUEL CONTROL SYSTEM WITH HEGO CURRENT PUMPING

[75] Inventors: Douglas R. Hamburg, Bloomfield; Eleftherios M. Logothetis, Birmingham; Jeffrey A. Cook; Lajos Rimai, both of Dearborn, all of Mich.

[73] Assignee: Ford Motor Company, Dearborn, Mich.

[21] Appl. No.: 132,407

[22] Filed: Oct. 6, 1993

[51] Int. Cl.[6] ..... F01N 3/20

[52] U.S. Cl. ..... 60/276; 60/285; 123/703

[58] Field of Search ..... 60/276, 285, 274, 277; 123/672, 703

[56] References Cited

U.S. PATENT DOCUMENTS 4,046,118 9/1977 Aono ..... 60/276
4,057,042 11/1977 Aono .
4,167,924 9/1979 Carlson ..... 60/285
4,167,925 9/1979 Hosaka ..... 60/276
4,210,106 7/1980 Wessel ..... 60/276
4,534,330 8/1985 Osuga ..... 123/440

*Primary Examiner*—Ira S. Lazarus
*Assistant Examiner*—Daniel J. O'Connor
*Attorney, Agent, or Firm*—Allan J. Lippa; Roger L. May

[57] ABSTRACT

A control system for maintaining engine air/fuel operation within the efficiency window of a catalytic converter. An exhaust gas oxygen sensor having a step change between first and second output states and positioned downstream of the converter. A step change in the downstream sensor output is initialized to an initial air/fuel ratio by pumping current through one of the sensing electrodes of the downstream sensor. An emission control signal is derived from the initialized downstream sensor output to bias an air/fuel feedback loop.

12 Claims, 8 Drawing Sheets

AIR/FUEL CONTROL SYSTEM WITH HEGO CURRENT PUMPING

BACKGROUND OF THE INVENTION

The field of the invention relates to control systems for maintaining engine air/fuel operation within the peak efficiency window of a catalytic converter.

Air/fuel control systems are known which are responsive to exhaust gas oxygen sensors positioned both upstream and downstream of a catalytic converter. Typically, a feedback variable is derived by integrating the output of a two-state exhaust gas oxygen sensor positioned upstream of the catalytic converter. This upstream exhaust gas oxygen sensor has a step change in its output, switching between rich and lean output states, at a preselected air/fuel ratio. Similarly, the downstream sensor is a two-state device with an output step change between rich and lean indicating steps occurring at a predetermined air/fuel ratio. An output from the downstream sensor biases the upstream feedback loop so that on average the engine's air/fuel ratio is aligned with the step change in the downstream sensor's output.

The inventors herein have recognized that the step output of the downstream sensor and corresponding predetermined air/fuel ratio may not be in alignment with the peak efficiency window of the catalytic converter.

SUMMARY OF THE INVENTION

An object of the invention claimed herein is to more accurately align the step change in the output of an exhaust gas oxygen sensor positioned downstream of a catalytic converter with the converter's peak efficiency window.

The above object is achieved, and problems of prior approaches overcome, by providing a control system for maintaining engine air/fuel operation within the efficiency window of a catalytic converter positioned in the engine exhaust. In one particular aspect of the invention, the system comprises: a downstream exhaust gas oxygen sensor positioned in the engine exhaust downstream of a catalytic converter having an output with a step change between first and second output states at a predetermined air/fuel ratio, the downstream sensor comprising first and second electrodes of differing oxygen concentrations separated by an oxygen-ion-conducting material; and initialization means for shifting the step change of the downstream sensor to an initial air/fuel ratio within the efficiency window of the converter, the initialization means including current means for generating current flow in the first electrode of the downstream sensor.

An advantage of the above aspect of the invention is that the step change in the downstream exhaust gas oxygen sensor output is accurately aligned with the converter's peak efficiency window, and a highly accurate air/fuel control system responsive to the downstream sensor is thereby achieved.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
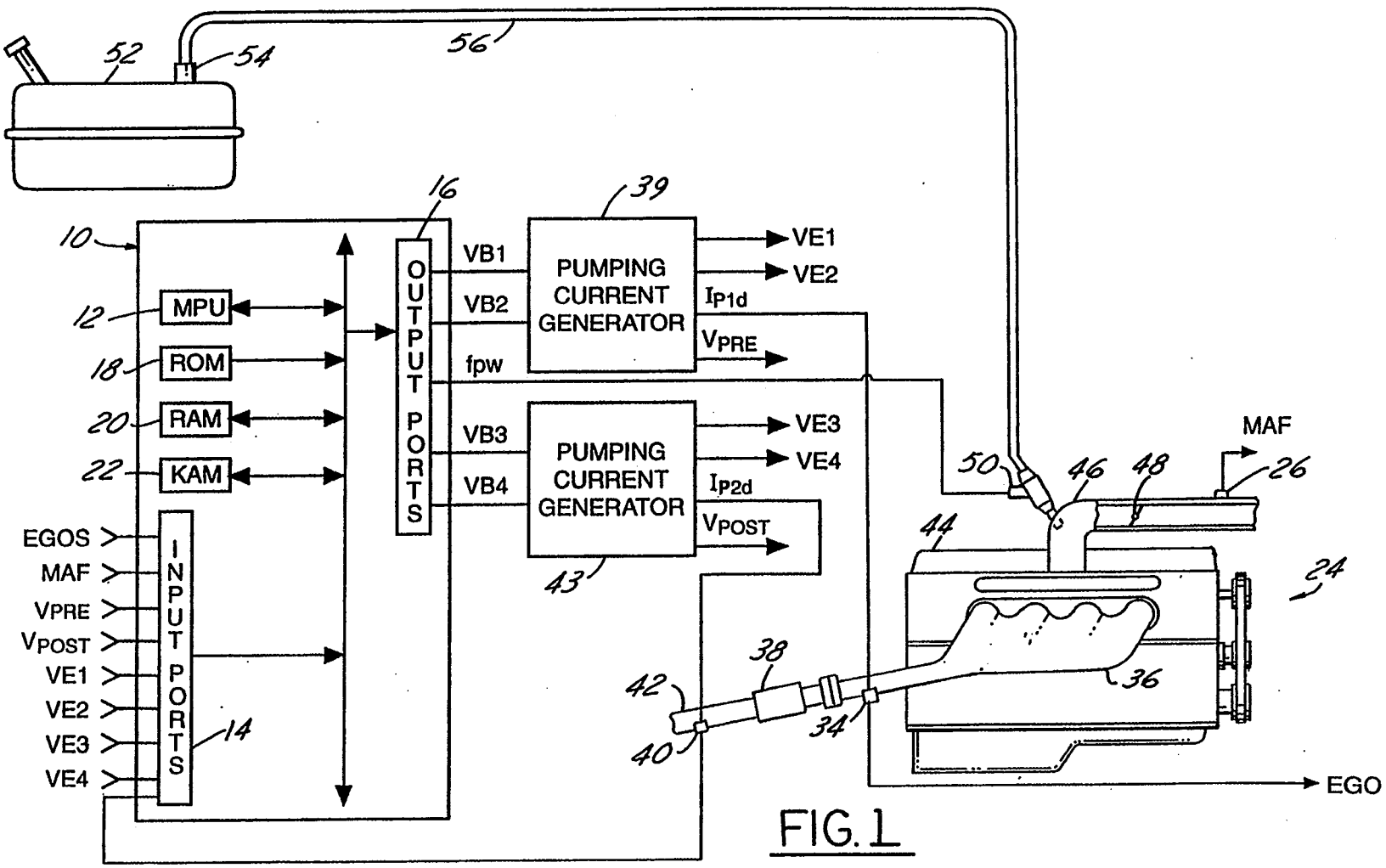
FIG. 1 is a block diagram of an embodiment wherein the invention is used to advantage.

Controller 10 is shown in the block diagram of FIG. 1 as a conventional microcomputer including: microprocessor unit 12; input ports 14 including both digital and analog outputs; output ports 16 including both digital and analog inputs; read only memory (ROM) 18 for storing control programs; random access memory (RA) 20 for temporary data storage which may also be used for counters or timers; keep-alive memory (KAM) 22 for storing learned values; and a conventional data bus. As described in greater detail later herein with particular reference to the remaining Figures, controller 10 controls the liquid fuel delivered to engine 24 via pulse width modulation of signal fpw.

Figure 2A:
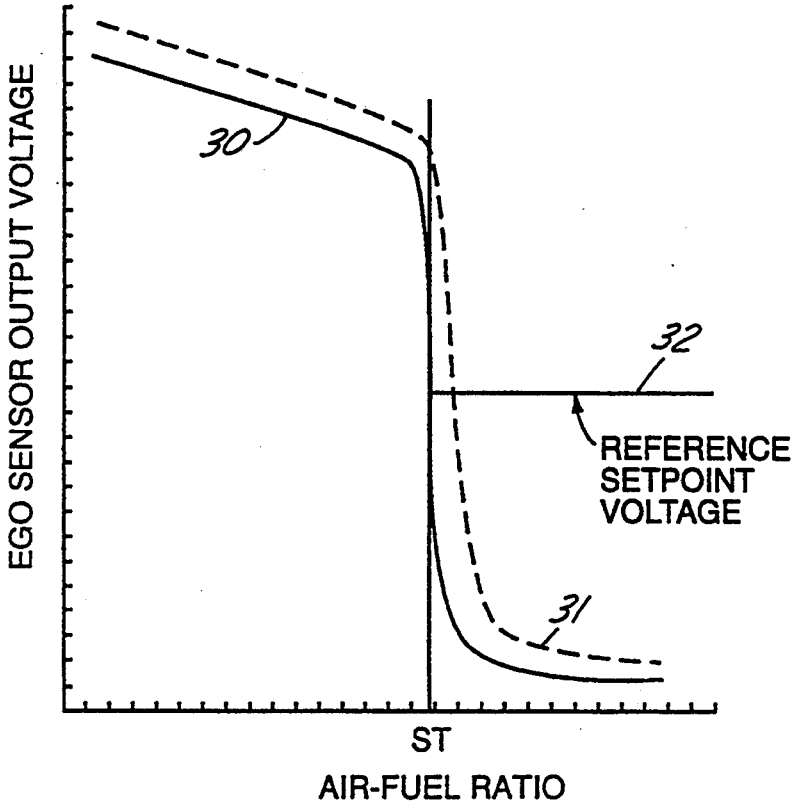
FIGS. 2A and 2B illustrate various outputs associated with of an exhaust gas oxygen sensor.
Figure 2B:
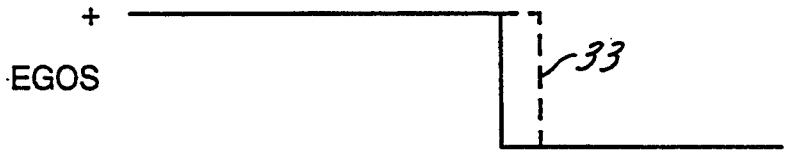

As shown in FIGS. 2A and 2B, a step change in the output of the EGO sensor occurs at an air/fuel ratio (AFR) which is predetermined for a particular sensor. Signal EGOS, as described in greater detail later herein, is generated by comparing the output voltage of EGO sensor 34 (line 30) to a reference voltage (line 32) shown in this example at a midpoint in peak-to-peak excursion of the output step change from EGO sensor 34. Signal EGOS is a two-state signal which indicates whether combustion gases are rich or lean of the air/fuel ratio corresponding to the output midpoint from EGO sensor 34. For the particular example presented herein, dashed lines 31 and 33 in FIG. 2A and 2B respectively represent shifts in EGO sensor 34 output and signal EGOS with respect to the converter's efficiency window.

In this particular example, pre-catalyst EGO sensor 34 is shown coupled to exhaust manifold 36 of engine 24 upstream of conventional catalytic converter 38. First pumping current generator 39 is shown coupled to controller 10 for biasing EGO sensor 34 as described in greater detail later herein. Post-catalyst EGO sensor 40 is shown coupled to tailpipe 42 downstream of conventional catalytic converter 38. Second pumping current generator 43 is shown coupled to controller 10 for biasing EGO sensor 40 as described in greater detail later herein.

Intake manifold 44 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 3:
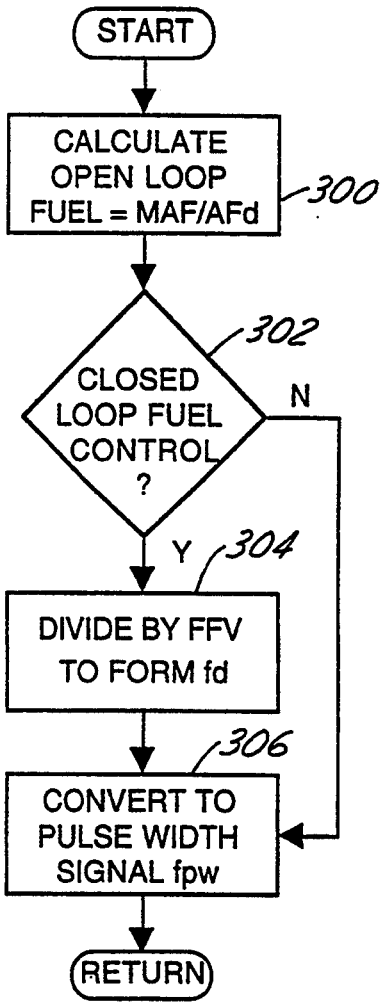
FIGS. 3 and 4 are high level flowcharts illustrating various steps performed by a portion of the embodiment illustrated in FIG. 1.

A flowchart of the liquid fuel delivery routine executed by controller 10 for controlling engine 24 is now described commencing with reference to the flowchart shown in FIG. 3. An open loop calculation of desired liquid fuel is calculated in step 300. More specifically, measurement of inducted mass airflow MAF is divided by desired air/fuel ratio AFd which is correlated with stoichiometric combustion. After closed loop or feedback control commences (step 302), the open loop fuel calculation is trimmed by fuel feedback variable FFV to generate desired fuel signal fd during step 304. This desired fuel signal is converted into fuel pulse width signal fpw for actuating fuel injector 50 (step 306).

Figure 4:
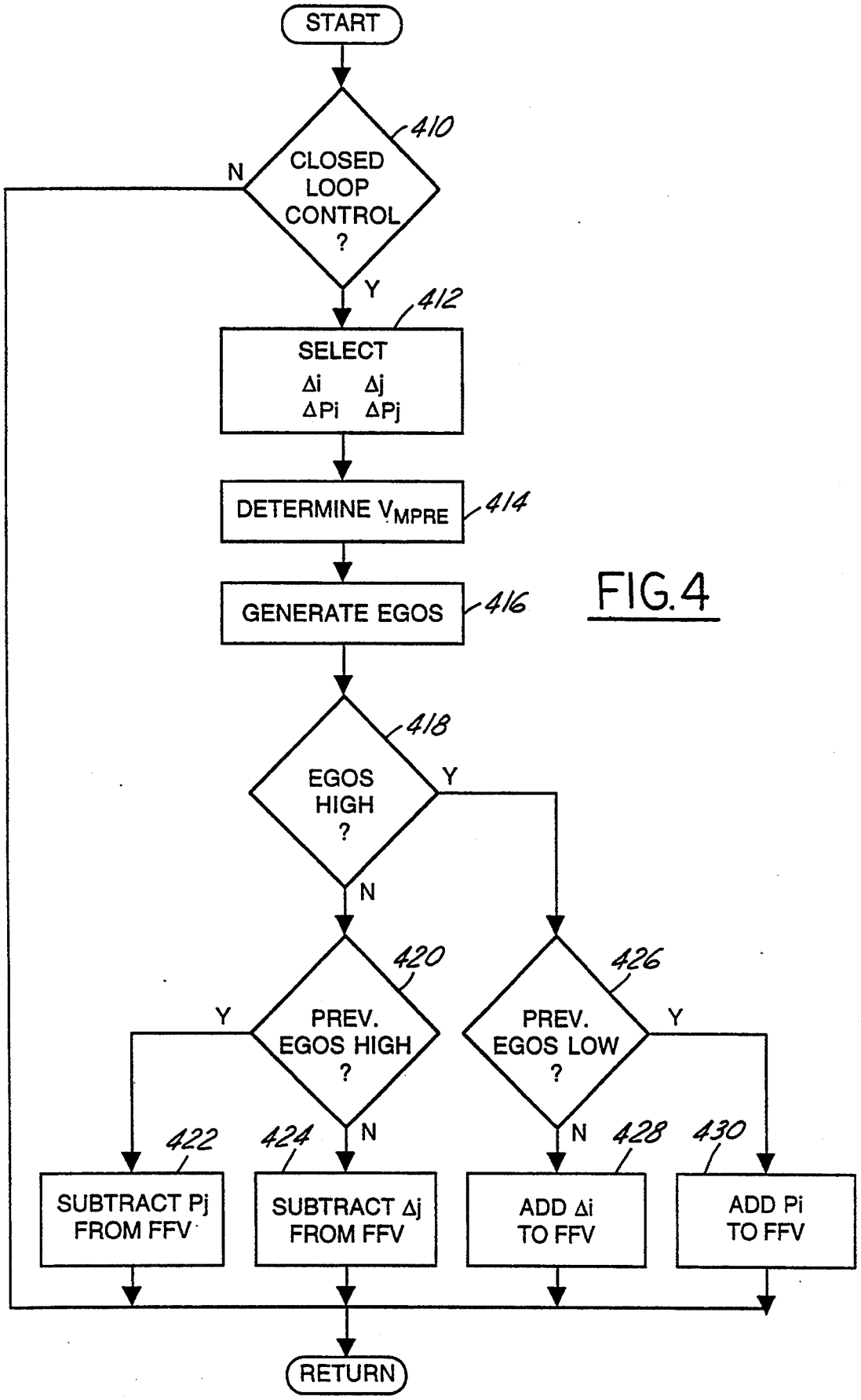

The air/fuel feedback routine executed by controller 10 to generate fuel feedback variable FFV is now described with reference to the flowchart shown in FIG. 4. After entering closed loop air/fuel control in step 410, modified output voltage $V_{MPRE}$ of EGO sensor 34 is determined (step 414). As described in greater detail later herein, the output of EGO sensor 34 is modified or shifted by current biasing in response to a post-catalyst feedback signal PCFS to align its output step change with the converter's efficiency window. The two-state exhaust gas oxygen sensor signal (EGOS) described above is generated in step 416 by comparing the modified output of EGO sensor 34 to the reference (see FIG. 2A). Two-state exhaust gas oxygen sensor signal EGOS is then sampled during step 418.

When signal EGOS is low (step 418), but was high during the previous background loop of microcontroller 10 (step 420), preselected proportional term Pj is subtracted from feedback variable FFV (step 422). When signal EGOS is low (step 418) and was also low during the previous background loop (step 420), preselected integral term Δj is subtracted from feedback variable FFV (step 424). Similarly, when signal EGOS is high (step 418), and was also high during the previous background loop of controller 10 (step 426), integral term Δi is added to feedback variable FFV (step 428). When signal EGOS is high (step 418), but was low during the previous background loop (step 426), proportional term Pi is added to feedback variable FFV (step 430).

In accordance with the above described operation, feedback variable FFV is generated by proportional plus integral feedback control responsive to signal EGOS. For the particular example herein, feedback variable FFV will oscillate around an average value of unity. In one alternative embodiment, the average value of feedback variable FFV will be biased to a value above or below unity as determined by post-catalyst feedback signal PCFS. When post-catalyst signal PCFS indicates that average engine air/fuel operation is rich of the converter's efficiency window proportional terms Pi, Pj and integral terms Δi, Δj are selected to achieve an average amplitude of feedback variable FFV which is greater than unity, thereby providing a lean bias to delivered fuel. Operation rich of the converter's efficiency window is thereby corrected. In one particular example of operation, proportional term Pi is increased relative to proportional term Pj, thereby biasing feedback variable FFV so that it is greater than unity on average. In another example of operation, a similar result is achieved by increasing integral term Δi relative to integral term Δj.

When post-catalyst feedback signal PCFS indicates engine air/fuel operation is lean of the efficiency window of converter 38, a combination of proportional terms Pi, Pj and/or integral terms Δi, Δj are selected to bias feedback variable FFV to an average value less than its nominal value or unity. A rich bias to the engine's air/fuel ratio is thereby provided. In an alternative embodiment, proportional term Pj is increased relative to proportional term Pi to bias feedback variable FFV to an average value less than unity. In another alternate embodiment, integral term Δj is increased relative to integral term Δi, thereby biasing feedback variable FFV to a value less than unity.

Figure 5:
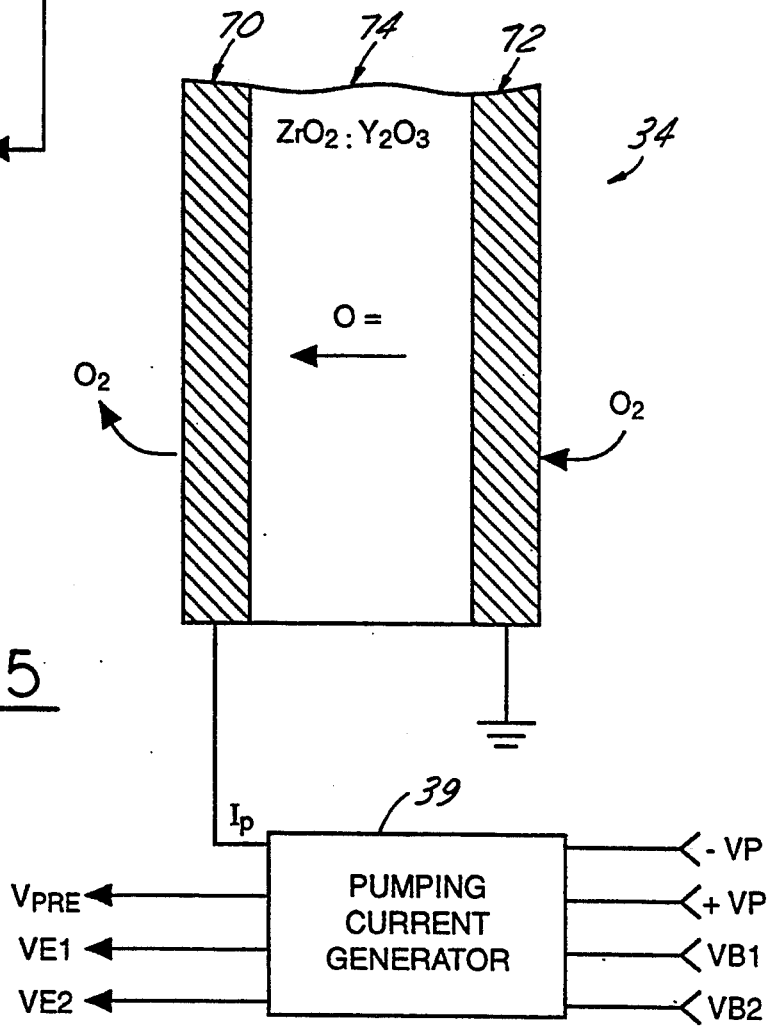
FIG. 5 is a sectional view of an exhaust gas oxygen sensor illustrating oxygen pumping in a portion thereof.

In the embodiment shown in FIG. 5, the precatalyst emission sensor comprises EGO sensor 34 having first and second electrodes 70 and 72 of differing oxygen concentrations separated by oxygen-ion-conducting material 74. Ideally the step change or "switch point" of the sensor output coincides with stoichiometric combustion. However, the step change is typically shifted to a value other than stoichiometry because of component aging or other system characteristics. To correct for such shifts the proportional plus integral feedback controller generating feedback variable FFV may be biased as described above.

In another alternate embodiment, pre-catalyst EGO sensor 34 is biased by generating current flow in first electrode 70 of sensor 34 so that oxygen is transferred or "pumped" from first electrode 70 to second electrode 72 or vice versa through oxygen-ion-conducting material 74. The current flow generated shifts the step change to higher or lower air/fuel values depending on the direction of the pumping current. Specifically, positive current flow in electrode 70 will shift the sensor switch point toward leaner air/fuel ratios, and negative current flow in electrode 70 will shift the sensor switch point toward richer air/fuel ratios. Moreover, the magnitude of this shift increases proportionally with the magnitude of the current. The magnitude and direction for the current is determined by post-catalyst feedback signal PCFS to shift the step change in the output of sensor 34 to coincide with the peak efficiency window of catalyst converter 38.

Figure 6A:
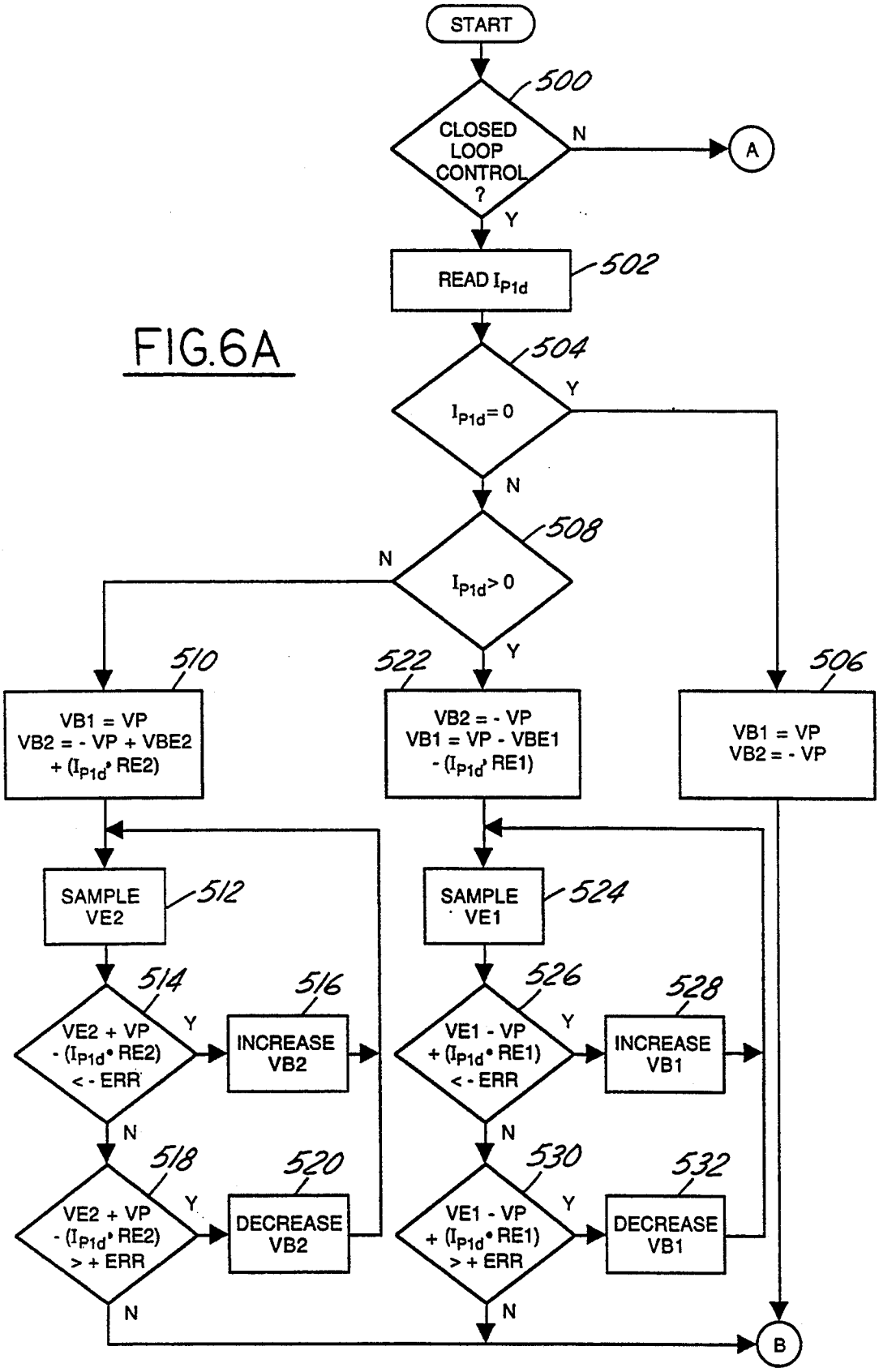
FIGS. 6A–6B are high level flowcharts illustrating various steps performed by a portion of the embodiment illustrated in FIG. 1.

Biasing of pre-catalyst sensor 34 is now described in more detail with reference to the flowchart shown in FIGS. 6A and 6B and the circuit diagram shown in FIG. 7. After a determination that closed loop control is desired (step 500), desired pumping current $I_{P1d}$ is determined in response to post-catalyst feedback signal PCFS (step 502). Post-catalytic feedback signal PCFS is an indicator of whether the engine air/fuel is centered in the catalyst window. In the described embodiment, signal PCFS is derived by sampling an output of post-catalyst emission sensing means, such as post-catalyst EGO sensor 40 (shown in FIG. 1), calculating a post-catalyst error signal by subtracting a reference voltage from the sensor output, and integrating the error signal. When post-catalytic feedback signal PCFS is zero (i.e., no error detected in the post-catalyst feedback loop), then the desired pumping current $I_{P1d}$ is zero (step 504) and the engine air/fuel is centered in the catalyst window. In this condition, no adjustment of the pre-catalyst closed-loop air/fuel is desired. Accordingly, controller 10 turns off transistors 80 and 82 by setting respective base voltages VB1 and VB2 equal to the positive and negative supply voltages +VP and −VP, respectively, so that pumping current will not flow in or out of EGO sensor 34 (step 506).

When the engine air/fuel is not in the catalyst window, $I_{P1d}$ is changed responsive to post-catalytic feedback signal PCFS so that the step change in output voltage of sensor 34 will be shifted into the catalyst window. For example, when desired pumping current $I_{P1d}$ is less than zero (step 508), controller 10 turns transistor 80 off by setting VB1 equal to +VP, and operates transistor 82 in its linear range by adjusting VB2 to control the current flow out of the sensor (step 510). Specifically, $$VB2 = -VP + VBE2 + (I_{P1d} * RE2)$$

wherein VBE2 is the internal base-to-emitter voltage of transistor 82, and RE2 is resistor 84 connected between the emitter of transistor 82 and the negative supply voltage −VP. To force actual current flow $I_{1pa}$ out of electrode 70 to be equal to desired pumping current $I_{P1d}$, emitter voltage VE2 of transistor 82 is sampled by controller 10 (step 512) to check the voltage drop across resistor 84. If the voltage drop across resistor 84 is such that VE2+VP−($I_{P1d}$ * RE2) is less than lower error limit −ERR, then current $I_{P1a}$ is less than desired pumping current $I_{P1d}$ (step 514). Accordingly, VB2 is slightly increased (step 516), thereby increasing the pumping current flow out of electrode 70. Conversely, if the voltage drop across resistor 84 is such that VE2+VP−($I_{P1d}$ * RE2) is greater than some upper error limit, +ERR, then current $I_{P1a}$ is greater than desired pumping current $I_{P1d}$ (step 518). Accordingly, VB2 is slightly decreased (step 520), thereby decreasing the pumping current flow out of electrode 70. Step 512 will repeat until the error is within allowable limits.

Alternatively, when desired pumping current $I_{P1d}$ is greater than zero (step 508), controller 10 turns transistor 82 off by setting VB2 equal to −VP, and operates transistor 80 in its linear range by adjusting VB1 to control the current flow into electrode 70 (step 522). Specifically, $$VB1 = VP - VBE1 - (I_{P1d} * RE1)$$

wherein VBE1 is the internal base-to-emitter voltage of transistor 80, and RE1 is resistor 86 connected between the emitter of transistor 80 and the positive supply voltage +VP. To force actual current flow $I_{P1a}$ into electrode 70 to be equal to the desired pumping current $I_{P1d}$, emitter voltage VE1 of transistor 80 is sampled by the controller 10 (step 524) to check the voltage drop across RE1. If the voltage drop across resistor 86 is such that VE1−VP+($I_{P1d}$ * RE1) is less than lower error limit −ERR, then current $I_{p1a}$ is greater than desired pumping current $I_{P1d}$ (step 526). Accordingly, VB1 is slightly increased (step 528), thereby decreasing the pumping current flow into electrode 70. Conversely, if the voltage drop across resistor 86 is such that VE1−VP+($I_{P1d}$ * RE1) is greater than some upper error limit, +ERR, then current $I_{P1a}$ is less than desired pumping current $I_{P1d}$ (step 530). Accordingly, VB1 is slightly decreased (step 532), thereby increasing the pumping current being pumped into electrode 70. Step 524 will repeat until the error is within allowable limits.

Pumping current into or out of pre-catalyst EGO sensor 34 not only shifts the step change of the sensor output, but also results in a shift in the output voltage level due to a voltage drop across the internal impedance of the sensor. When the internal impedance of the sensor is low, the shift may be negligible so that no compensation for the voltage shift is necessary. Because of this, it is desirable to use a low impedance sensor. In the described embodiment, however, voltage adjusting means are alternatively provided to compensate for this shift in voltage level. Generally, the internal impedance of EGO sensor 34 depends on the temperature of the engine exhaust. While other temperature determining methods may be used, engine speed and load are used together in the described embodiment as a convenient estimator of this temperature.

Figure 6B:
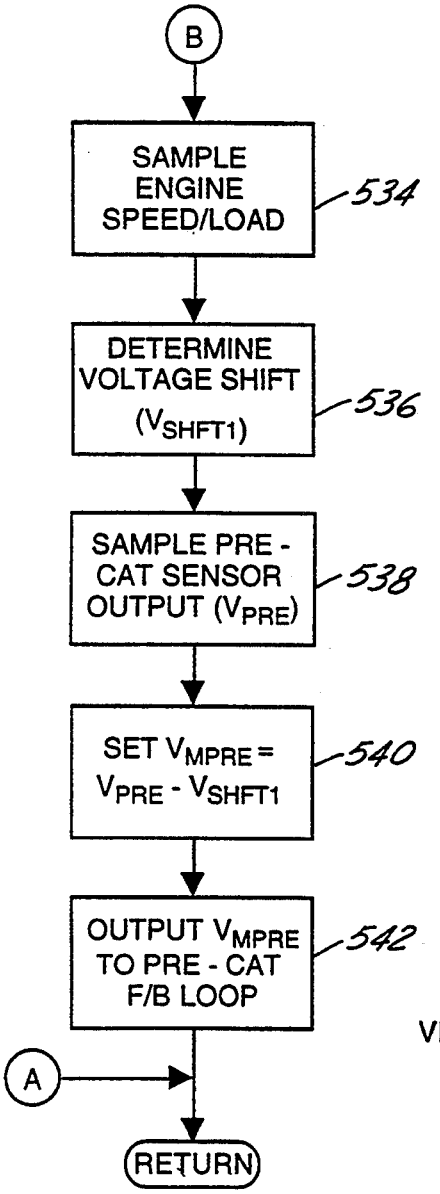
Figure 7:
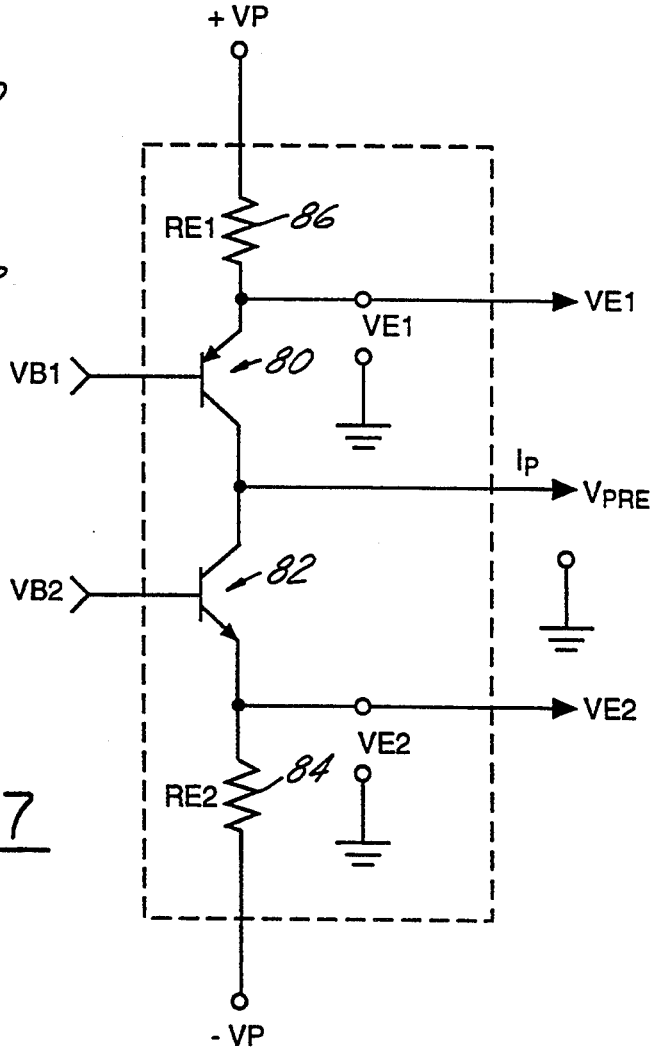
FIGS. 7 and 8 are schematic diagrams of portions of the embodiment illustrated in FIG. 1.

Continuing with FIG. 6B, the voltage adjustment to compensate for changes in internal impedance is now described. When the pumping current error is within allowable limits, controller 10 samples engine speed and load (step 534). The value of the shift in voltage level, $V_{SHFT1}$, is then read from a table providing $V_{SHFT1}$ as a function of desired pumping current $I_{P1d}$, engine speed and engine load (step 536). Next, controller 10 samples output voltage $V_{PRE}$ of pre-catalyst EGO sensor 34 (step 538) and calculates modified output voltage $V_{MPRE}$ by subtracting $V_{SHFT1}$ from $V_{PRE}$ (step 538). Modified output voltage $V_{MPRE}$ is then used in the pre-catalyst air/fuel feedback loop to generate signal EGOS as previously described.

Figure 8:
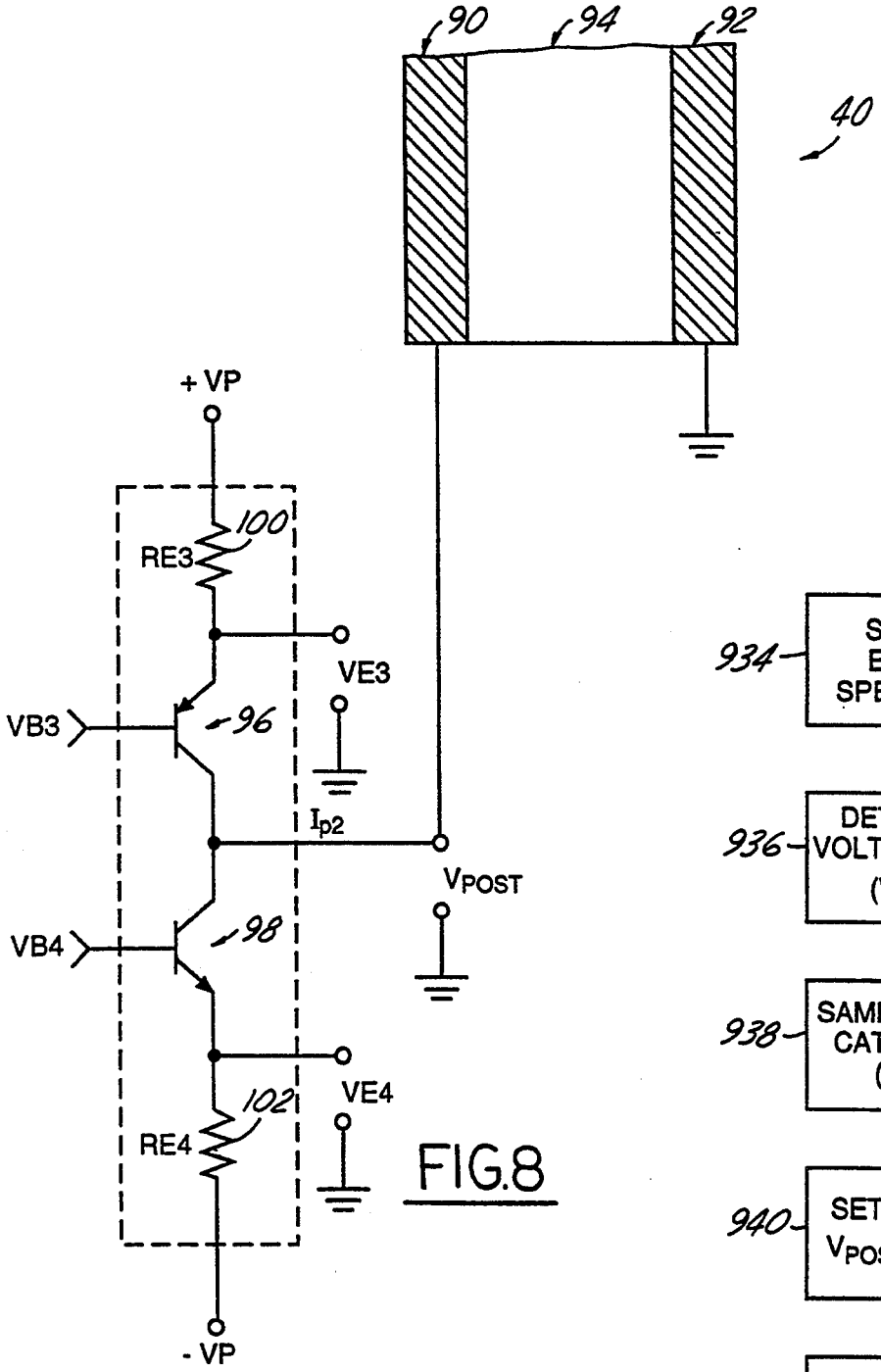

Initializing post-catalyst EGO sensor 40 is now described with reference to the circuit diagram shown in FIG. 8 and the flowchart shown in FIGS. 9A and 9B. In this example, EGO sensor 40 comprises an exhaust gas oxygen sensor having first and second electrodes 90 and 92 of differing oxygen concentrations separated by oxygen-ion-conducting material 94. As with pre-catalyst sensor 34, the step change in the output of post-catalyst sensor 40 can be shifted to richer or leaner air/fuel values by choosing an appropriate magnitude and direction for the current in electrode 90. By controlling the current into electrode 90, the step change of sensor 40 can be advantageously shifted or initialized to an initial air/fuel ratio.

Figure 9B:
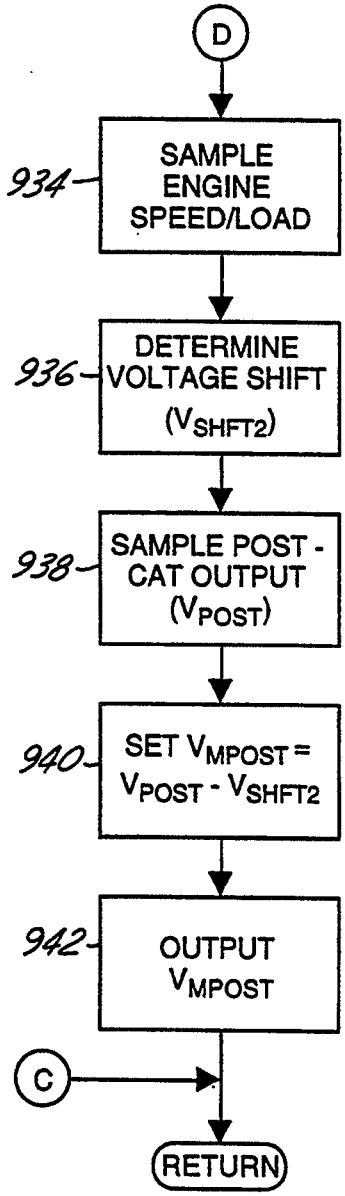
FIGS. 9A–9B are high level flowcharts illustrating various steps performed by a portion of the embodiment illustrated in FIG. 1.
Figure 9A:
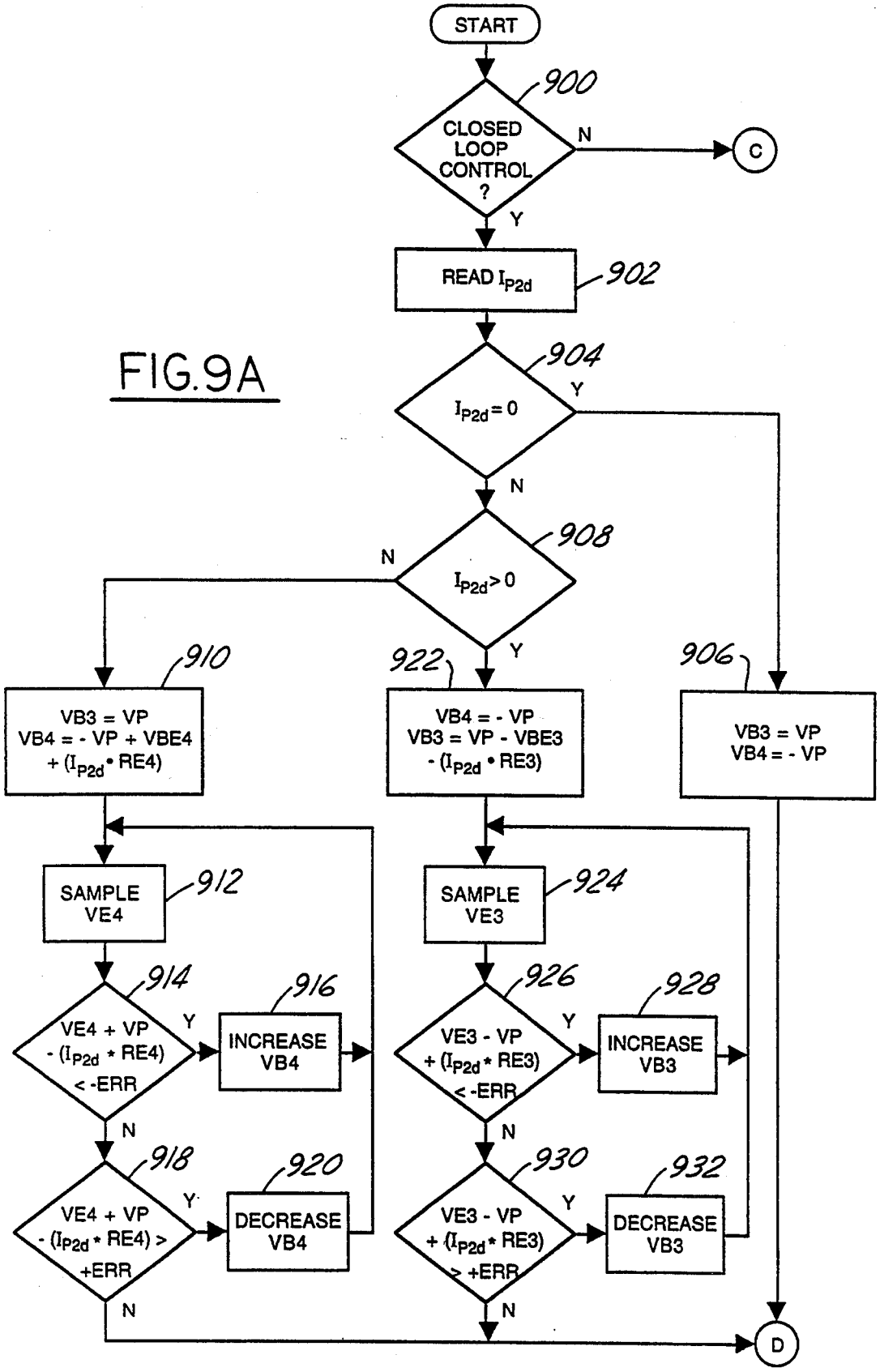

Referring now to FIG. 9A, after commencing closed loop control (step 900), pumping current $I_{P2d}$ is determined in response to an initial or predetermined air/fuel ratio derived from empirical data. In one embodiment, the initial air/fuel ratio is set to a predetermined fixed value. In an alternate embodiment, the initial air/fuel ratio is adjusted in response to engine operating conditions. For example, values for pumping current $I_{P2d}$ obtained during a routine calibration process are stored in ROM 18 of controller 10 as a function of engine speed and load. Precise measurements are performed during feedback air/fuel control to empirically determine post-catalyst sensor pumping current values to optimize catalyst conversion efficiency at various engine operating points. The pumping current values are then stored in specific speed/load cells set up in a table in ROM which correspond to the chosen engine operating points used in the calibration process. If the actual engine speed and load do not correspond exactly with a speed/load cell in the table, the value of pumping current $I_{P2d}$ used in step 902 is interpolated from values read from cells surrounding the actual operating point.

When pumping current $I_{P2d}$ is zero (step 904), post-catalyst EGO sensor 40 is switching at the initial air/fuel ratio and no adjustment of the step change is required. Accordingly, controller 10 turns off transistors 96 and 98 by setting respective base voltages VB3 and VB4 equal to the positive and negative supply voltages +VP and −VP, respectively, so that pumping current will not flow in or out of EGO sensor 40 (step 906).

When the step change in output voltage of EGO sensor 40 does not switch at the initial air/fuel ratio, initialization is required. Consequently, pumping current $I_{P2d}$ is set so that the step change shifts to coincide with the desired initial air/fuel ratio. For example, when pumping current $I_{P2d}$ is less than zero (step 908), controller 10 turns transistor 96 off by setting VB3 equal to +VP, and operates transistor 98 in its linear range by adjusting VB4 to control the current flow out of EGO sensor 40 (step 910). Specifically, $$VB4 = -VP + VBE4 + (I_{P2d} * RE4)$$

wherein VBE4 is the internal base-to-emitter voltage of transistor 98, and RE4 is resistor 100 connected between the emitter of transistor 98 and negative supply voltage −VP. To force actual current flow $I_{P2a}$ out of electrode 90 to be equal to desired current $I_{P2d}$, emitter voltage VE4 of transistor 98 is sampled by controller 10 (step 912) to check the voltage drop across resistor 100. If the voltage drop across resistor 100 is such that VE4+VP−($I_{P2d}$ * RE4) is less than lower error limit -ERR, then current $I_{P2a}$ is less than current $I_{P2d}$ (step 914). Accordingly, VB4 is slightly increased (step 916), thereby increasing the pumping current flow out of electrode 90. Conversely, if the voltage drop across resistor 100 is such that VE4+VP−($I_{P2d}$ * RE4) is greater than upper error limit +ERR, then current $I_{P2a}$ is greater than current $I_{P2d}$ (step 918). Accordingly, VB4 is slightly decreased (step 920), thereby decreasing the pumping current flow out of electrode 90. Step 912 will repeat until the error is within allowable limits.

Alternatively, when current $I_{P2d}$ is greater than zero (step 908), controller 10 turns transistor 98 off by setting VB4 equal to −VP, and operates transistor 96 in its linear range by adjusting VB3 to control the current flow into electrode 90 (step 922). Specifically, $$VB3 = VP - VBE3 - (I_{P2d} * RE3)$$

wherein VBE3 is the internal base-to-emitter voltage of transistor 96, and RE3 is resistor 102 connected between the emitter of transistor 96 and the positive supply voltage +VP. To force actual current flow $I_{P2a}$ into electrode 90 to be equal to desired current $I_{P2d}$, emitter voltage VE3 of transistor 96 is sampled by the controller 10 (step 924) to check the voltage drop across resistor 102. If the voltage drop across resistor 102 is such that VE3−VP+($I_{P2d}$ * RE3) is less than lower error limit −ERR, then current $I_{P2a}$ is greater than current $I_{P2d}$ (step 26). Accordingly, VB3 is slightly increased (step 928), thereby decreasing the pumping current flow into electrode 90. Conversely, if the voltage drop across resistor 102 is such that VE3−VP+($I_{P2d}$ * RE3) is greater than upper error limit +ERR, then current $I_{P2a}$ is less than current $I_{P2d}$ (step 930). Accordingly, VB3 is slightly decreased (step 932), thereby increasing the pumping current being pumped into electrode 90. Step 924 will repeat until the error is within allowable limits.

As with pre-catalyst EGO sensor 34, pumping current into or out of post-catalyst EGO sensor 40 shifts not only the step change of the output, but also shifts the voltage level of the output due to the voltage drop across the internal impedance of the sensor. Therefore, the voltage adjusting described below is provided to compensate for this shift in the voltage level of the post-catalyst sensor output.

Continuing with FIG. 9B, when the pumping current error is within allowable limits, controller 10 samples engine speed and load (step 934). The value of the shift in voltage level, $V_{SHFT2}$, is then read from a table providing $V_{SHFT2}$ as a function of current $I_{P2d}$, engine speed and engine load (step 936). Next, controller 10 samples output voltage $V_{POST}$ of post-catalyst EGO sensor 40 (step 938) and calculates modified post-catalyst sensor output voltage $V_{MPOST}$ by subtracting $V_{SHFT2}$ from $V_{POST}$ (step 940). The modified output signal is then transferred (942) to a comparator and integrator to generate emission signal PCFS as previously described herein.

Although one example of an embodiment which practices the invention has been described herein, there are numerous other examples which could also be described. For example, other combinations of analog devices and discrete ICs may be used to advantage to generate the current flow in the sensors' electrodes. The invention is therefore to be defined only in accordance with the following claims.

What is claimed:

1. A control system for maintaining engine air/fuel operation within the efficiency window of a catalytic converter positioned in the engine exhaust, comprising:

a downstream exhaust gas oxygen sensor positioned downstream of the catalytic converter having an output with a step change between first and second output states at a predetermined air/fuel ratio, said downstream sensor comprising first and second electrodes of differing oxygen concentrations separated by an oxygen-ion-conducting material;

initialization means for shifting said step change of said downstream sensor to an initial air/fuel ratio within the efficiency window of the converter, said initialization means including current means for generating current flow in said first electrode of said downstream sensor;

fuel control means for supplying fuel to the engine in response to at least said downstream sensor; and an upstream exhaust gas oxygen sensor positioned upstream of the converter having an output with a step change between first and second output states at a selected air/fuel ratio determined by a biasing means; error means being responsive to said downstream sensor for generating an error signal related to variance between said selected air/fuel ratio and said initial air/fuel ratio; and said biasing means being responsive to said error signal for shifting said step change of said upstream sensor and said selected air/fuel ratio to reduce said error signal.

2. The control system recited in claim 1 wherein said fuel control means maintains engine air/fuel operation on average at said selected air/fuel ratio.

3. A control system for maintaining engine air/fuel operation within the efficiency window of a catalytic converter positioned in the engine exhaust, comprising:

a downstream exhaust gas oxygen sensor positioned downstream of the catalytic converter having a step change between first and second output states, said downstream sensor comprising first and second electrodes of differing oxygen concentrations separated by an oxygen-ion-conducting material;

initialization means coupled to said downstream sensor for shifting said step change to an initial air/fuel ratio, said initialization means including current means for generating current flow in said first electrode of said downstream sensor;

adjusting means for shifting said initial air/fuel ratio in response to engine operating conditions; and fuel adjusting means for supplying fuel to the engine in response to at least said downstream exhaust gas oxygen sensor.

4. The control system recited in claim 3 wherein said engine operating conditions include engine speed and load.

5. A control system for maintaining engine air/fuel operation with in the efficiency window of a catalytic converter positioned in the engine exhaust comprising:

a downstream exhaust gas oxygen sensor positioned downstream of the catalytic converter having a step change between first and second output states, said downstream sensor comprising first and second electrodes of differing oxygen concentrations separated by an oxygen-ion-conducting material;

initialization means coupled to said downstream sensor for shifting said step change to an initial air/fuel ratio, said initialization means including current means for generating current flow in said first electrode of said downstream sensor;

adjusting means for shifting said initial air/fuel ratio in response to engine operating conditions;

fuel adjust means for supplying fuel to the engine in response to at least said downstream exhaust gas oxygen sensor; and an upstream exhaust gas oxygen sensor positioned upstream of the converter having an output with a step change between first and second output states at a selected air/fuel ratio determined by a biasing means; error means being responsive to said downstream sensor for generating an error signal related to variance between said selected air/fuel ratio and said initial air/fuel ratio; and said biasing means being responsive to said error signal for shifting said step change of said upstream sensor and said selected air/fuel ratio to reduce said error signal.

6. A system for maintaining engine air/fuel operation within the efficiency window of a catalytic converter positioned in the engine exhaust, comprising:

a downstream exhaust gas oxygen sensor positioned downstream of the converter having an output with a step change between first and second output states at a predetermined air/fuel ratio; said downstream sensor comprising first and second electrodes of differing oxygen concentrations separated by an oxygen-ion-conducting material;

initialization means including current means for generating current flow in said first electrode to shift said step change to an initial air/fuel ratio within the efficiency window of the converter;

an upstream exhaust gas oxygen sensor positioned upstream of the converter having an output with a step change between first and second output states at a selected air/fuel ratio determined by a biasing means;

error means being responsive to said downstream sensor for generating an error signal related to variance between said selected air/fuel ratio and said initial air/fuel ratio;

fuel control means for adjusting fuel delivered to the engine in response to said upstream sensor step change to maintain engine air/fuel operation on average at said selected air/fuel ratio; and said biasing means being responsive to said error signal for shifting said upstream sensor step change and said selected air/fuel ratio to reduce said error signal.

7. The system recited in claim 6 wherein said initial air/fuel ratio is a predetermined fixed value.

8. The system recited in claim 6 further comprising adjusting means for adjusting said initial air/fuel ratio with engine operating conditions, including engine speed and load.

9. The system recited in claim 6 wherein said current means includes feedback control means for controlling said current flow in said first electrode.

10. The system recited in claim 6 wherein said initialization means further includes voltage adjusting means for reducing variations in amplitude of said downstream sensor output caused by said current means.

11. The system recited in claim 6 wherein said fuel control means comprises: comparator means for comparing said upstream sensor output to a reference value to provide an electrical signal having a first voltage polarity when the exhaust gas oxygen level is below the reference value and having a second voltage polarity opposite said first voltage polarity when said exhaust oxygen level is above said reference value; and control means for providing a feedback variable to adjust said delivered fuel by integrating said electrical signal in predetermined steps each sampling time and adding a first preselected value having said first polarity when said electrical signal switches from said second polarity to said first polarity and adding a second preselected value having said second polarity when said electrical signal switches from said first polarity to said second polarity.

12. The system recited in claim 6 wherein said upstream sensor comprises first and second electrodes of differing oxygen concentrations separated by an oxygen-ion-conducting material, and said biasing means includes second current means for generating current flow in said first electrode of said upstream sensor for shifting said step change in said upstream sensor output to said initial air/fuel ratio.

* * * * *